US006409583B1

(12) United States Patent
Numoto

(10) Patent No.: US 6,409,583 B1
(45) Date of Patent: Jun. 25, 2002

(54) APPARATUS FOR POLISHING WAFERS

(75) Inventor: Minoru Numoto, Mitaka (JP)

(73) Assignee: Tokyo Seimtsu Co., Ltd., Tokyo (JP)

( * ) Notice: Subject to any disclaimer, the term of this patent is extended or adjusted under 35 U.S.C. 154(b) by 0 days.

(21) Appl. No.: 09/522,677

(22) Filed: Mar. 10, 2000

(30) Foreign Application Priority Data

May 7, 1999 (JP) ..... 11-126826

(51) Int. Cl.[7] ..... B24B 7/00

(52) U.S. Cl. ..... 451/259; 451/286; 451/288; 451/398

(58) Field of Search ..... 451/41, 259, 285, 451/286, 287, 288, 289, 290, 397, 398

(56) References Cited

U.S. PATENT DOCUMENTS

| | | | |
|---|---|---|---|
| 5,205,082 A | 4/1993 | Shendon et al. | 51/283 R |
| 5,584,751 A | 12/1996 | Kobayashi et al. | 451/288 |
| 5,643,061 A | 7/1997 | Jackson et al. | 451/289 |
| 6,283,834 B1 * | 9/2001 | Liauzu | |
| 6,290,577 B1 * | 9/2001 | Shendon et al. | |

FOREIGN PATENT DOCUMENTS

| | | |
|---|---|---|
| EP | 0 868 975 A1 | 10/1998 |
| EP | 0 881 039 A2 | 12/1998 |
| JP | 2-240925 | 9/1990 |
| JP | 6-79618 | 3/1994 |
| JP | 8-229808 | 9/1996 |
| JP | 10-175161 | 6/1998 |
| JP | 10-92030 | 12/1999 |

* cited by examiner

*Primary Examiner*—Joseph J. Hail, III
*Assistant Examiner*—Willie Berry, Jr.
(74) *Attorney, Agent, or Firm*—Christie, Parker & Hale, LLP

(57) ABSTRACT

An apparatus 1 for polishing wafers in which a first pushing means 50 for imparting a pushing force to a carrier 20 is arranged along the outer peripheral portion under the lower surface of a head body 40, and a second pushing means 60 for imparting a pushing force to a retainer ring 30 is arranged at a central portion under the lower surface of the head body. The first and second pushing means are formed of air bags 51 and 61.

4 Claims, 1 Drawing Sheet

APPARATUS FOR POLISHING WAFERS

BACKGROUND OF THE INVENTION

1. Field of the Invention

The present invention relates to an apparatus for polishing wafers and, particularly, to an apparatus for polishing semiconductor wafers relying upon a chemical-mechanical polishing (CMP) method.

2. Description of the Related Art

In recent years, ICs have been finely machined and IC patterns have been formed in a multiplicity of layers. Some degree of roughness is inevitably formed in the surfaces of the layers on which the patterns are formed. According to the prior art, the pattern of the next layer has been formed without any treatment. As the number of the layers increases and as the widths of the lines and holes decrease, however, it becomes difficult to form favorable patterns and defects occur easily. Therefore, it has been attempted to form the pattern of the next layer after the surface of the layer on which the pattern is formed is flattened by polishing. The wafer-polishing apparatus (CMP apparatus) based on the CMP method is employed to polish the wafer in the step of forming the IC patterns.

There has been widely employed a wafer-polishing apparatus comprising a disk-like polishing table having a polishing pad stuck on the surface thereof, a plurality of wafer-holder heads that hold the surfaces on one side of the wafers to be polished and bring the other surfaces of the wafers into contact with the polishing pad, and a holder head drive mechanism for turning the wafer-holder heads relative to the polishing stool, and wherein a slurry which is a polishing agent is supplied between the polishing pad and the wafers to polish the wafers.

There have been proposed various wafer-holder mechanisms for the wafer-holder heads, and some of them are the devices of the floating type as disclosed in Japanese Unexamined Patent Publications (Kokai) No. 6-79618 and No. 10-175161. According to these devices, the wafer is intimately held by being adsorbed by the carrier constituting a portion of the holder head, and the carrier is pushed to push the wafer onto the polishing pad to polish the wafer. An improved holder head in the wafer-polishing apparatus has also been known as taught in Japanese Unexamined Patent Publication (Kokai) No. 8-229808 and in Japanese Patent Application No. 10-92030 filed by the present applicant as schematically illustrated in FIG. 2.

As shown in FIG. 2, this holder head 10 comprises a carrier 20 that is in contact with the back surface of a wafer 2 that is to be polished to push it onto a polishing pad 3, a retainer ring 30 formed in a cylindrical shape to surround the carrier 20 and to push the polishing surface of the polishing pad 3 around the periphery of the wafer 2, a head body 40 provided over the carrier 20 and the retainer ring 30, a drive unit 41 for rotating the head body 40, an adjusting unit 50 (corresponds to a first pushing means) provided between the head body 40 and the carrier 20 to adjust the polishing pressure given to the carrier 20, and an adjusting unit 60 (corresponds to a second pushing means) provided between the head body 40 and the retainer ring 30 and gives a pushing force to the retainer ring 30 that pushes the polishing pad 3 and adjusts the pushing force. These adjusting units 50, 60 are formed of, for example, air bags. The air bag for the carrier at a central portion under the lower surface of the head body 40 is independent from the air bag for the retainer ring along the outer periphery thereof. These air bags separately work to adjust the pushing forces of the carrier 20 and the retainer ring 30.

In general, the pushing forces of the carrier and the retainer ring are equal per a unit area or are slightly different. The retainer ring has a width of usually from 10 to 20 mm and has an area which is about one-fourth to one-half the area of the wafer. In the conventional device as shown in FIG. 2, the air bag for the retainer ring is located along the outer periphery under the lower surface of the head body. Therefore, the area for receiving the pressure increases unless the width A of the air bag is narrowed, making it difficult to finely control the pushing force; i.e., the air pressure must be finely controlled making it difficult to precisely control the-pushing force.

Besides, when the rubber width A of the air bag is narrow, the rubber is not elongated to a sufficient degree making it difficult to control the pushing force.

SUMMARY OF THE INVENTION

The present invention was accomplished in view of the above-mentioned problems, and its object is to provide an apparatus for polishing wafers equipped with air bags which enable the rubber width A to be broadened so that the elasticity of a rubber sheet of the air bags for pushing a carrier and a retainer ring can be sufficiently utilized and that the air pressure in the air bags needs not be finely controlled.

As a means for solving the above-mentioned problems, the present invention provides an apparatus for polishing wafers described in the claims.

In the apparatus for polishing wafers according to an embodiment of the present invention, the force for pushing the carrier is obtained from a first pushing means along the outer periphery on the lower surface of the head body and the force for pushing the retainer ring is obtained from a second pushing means at a central portion under the lower surface of the head body, maintaining a pressure-receiving area of the carrier that requires a large force and arranging the second pushing means for the retainer ring without causing its width A to be reduced.

In the apparatus for polishing wafers according to another embodiment of the present invention, the first and second pushing means comprise air bags made of a rubber sheet, enabling the elasticity of the rubber sheet to be sufficiently utilized, and the rubber width A to be increased, so that the air pressure can be controlled even with a small force instead of a very fine pressure control.

In the apparatus for polishing wafers according to a further embodiment of the present invention, the first and second pushing means are applied to the apparatus in which the carrier is equipped with an air-blow member.

The present invention may be more fully understood from the description of preferred embodiments of the invention set forth below, together with the accompanying drawings.

DESCRIPTION OF THE PREFERRED EMBODIMENTS

Figure 1:
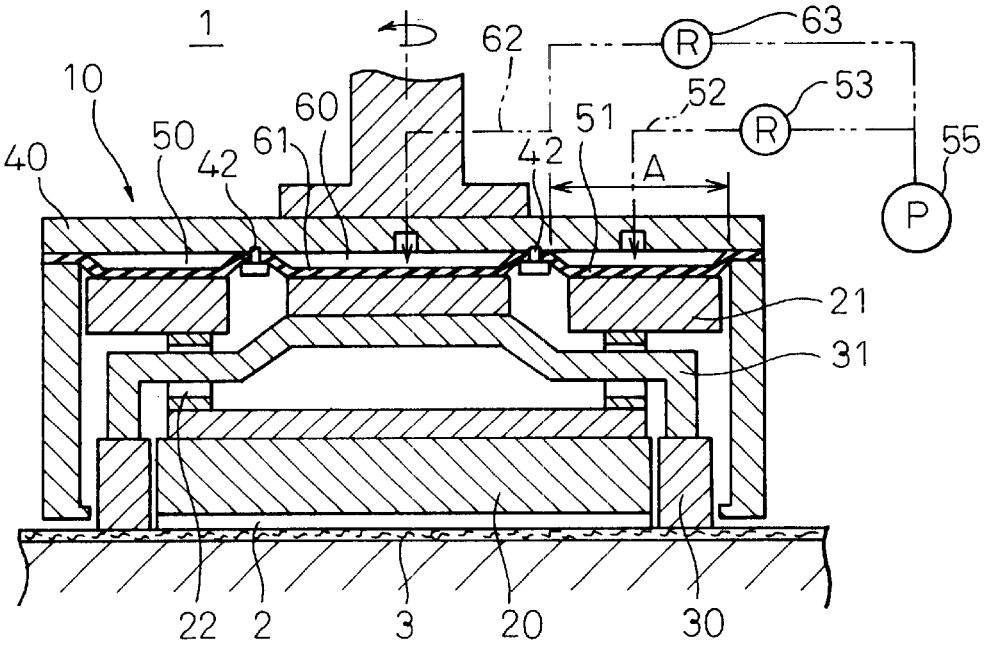
FIG. 1 is a vertical sectional view of an apparatus for polishing wafers according to an embodiment of the present invention.

An apparatus for polishing wafers according to an embodiment of the present invention will now be described with reference to the drawing. FIG. 1 is a vertical sectional view of the apparatus 1 for polishing wafers of the present invention.

The polishing apparatus 1 includes a polishing table 4 having a polishing pad 3 stretched on the upper surface to polish a semiconductor wafer 2, and a holder head 10 that holds the wafer 2, pushes it onto the polishing pad with a predetermined pressure, and rotates.

The polishing table 4 has a rotary drive unit (not shown) that rotates in a horizontal polishing direction relative to the holder head 10.

The holder head 10 includes a carrier 20 that holds the back surface of the wafer 2 that is to be polished and pushes the wafer onto the polishing pad 3, a retainer ring 30 formed in a cylindrical shape to surround the carrier 20 and pushes the polishing surface of the polishing pad 3 in the periphery of the wafer 2, a head body 40 provided over the carrier 20 and the retainer ring 30, a drive unit 41 for rotating the head body 40, a first pushing means 50 provided between the head body 40 and the carrier 20 and adjusts the polishing pressure given to the carrier 20, and a second pushing means 60 provided between the head body 40 and the retainer ring 30, gives a force for pushing the polishing pad 3 onto the retainer ring 30, and adjusts the pushing force.

Figure 2:
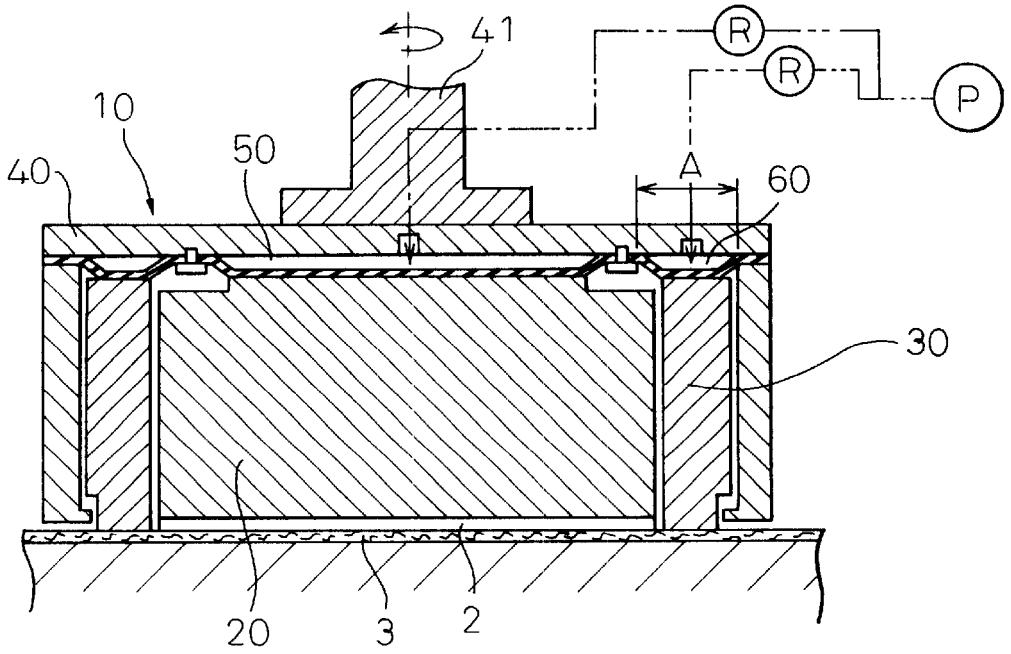
FIG. 2 is a vertical sectional view of a conventional apparatus for polishing wafers.

The carrier 20 is provided with a carrier pushing member 21 that transmits the pushing force from the first pushing means 50 to the carrier 20. Further, the retainer ring 30 is provided with a retainer ring-pushing member 31 for transmitting the pushing force from the second pushing means 60 to the retainer ring 30. These pushing members 21 and 31 must be arranged in a crossing manner relative to each other, and have a leg structure. Or, one pushing member (carrier-pushing member 21 in FIG. 2) is provided with openings 22 that penetrate through the other pushing member (retainer ring-pushing member 31).

The first pushing means 50 is arranged along the outer periphery under the lower surface of the head body 40, gives a pushing force to the carrier-pushing member 21, which is then transmitted to the carrier 20 coupled thereto to push the wafer 2 held by the carrier 20 onto the polishing pad 3. The first pushing means 50, preferably, comprises an air bag 51 made of a rubber sheet which expands and contracts upon introducing and discharging the air to adjust the polishing pressure, and is provided, being coupled thereto, with an air-feeding mechanism 52 for feeding the air to the air bag 51. The air-feeding mechanism 52 is provided with a regulator 53 for adjusting the pressure of the air fed from a common pump or from separate pumps 55.

The second pushing means 60 is disposed at a central portion under the lower surface of the head body 40, gives a pushing force to the retainer ring-pushing member 31, which is then transmitted to the retainer ring 30 coupled thereto; i.e., the retainer ring 30 is pushed onto the polishing pad 3. The second pushing means 60, too, comprises an air bag 61 made of a rubber sheet that expands and contracts upon introducing and discharging the air to adjust the polishing pressure, and is provided, being coupled thereto, with an air-feeding mechanism 62 for feeding the air to the air bag 61. The air-feeding mechanism 62 is provided with a regulator 63 for adjusting the pressure of the air fed from a common pump or separate pumps 55. The air bags 51 and 61 may be formed of separate rubber sheets. Or, a piece of rubber sheet may be used, and the air bags 51 and 61 may be separated from each other by using a partitioning member 42.

In polishing the wafer 2 by using the wafer-polishing apparatus 1, the air pressure in the air bag 51 is adjusted by the air-feeding mechanism 52 in the first pushing means 50 to adjust the polishing pressure imparted to the carrier 20. Similarly, the force by which the retainer ring 30 is pushed onto the polishing pad 3 is adjusted by the second pushing means 60. This prevents the polishing surface from swelling along the peripheral edge of the wafer 2.

The carrier 20 of the above-mentioned wafer-polishing apparatus 1 is not provided with an air-blowing member. However, the first and second pushing means 50 and 60 of the present invention can be applied, as a matter of course, to the polishing apparatus of the type in which the carrier 20 is provided with the air-blowing member, a pressurized air layer is formed relative to the wafer 2 by the air blown from the air-blowing member, and the carrier 20 transmits the pushing force of the first pushing means 50 to the wafer 2 through the pressurized air layer to push the wafer 2 onto the polishing pad 3.

The forces for pushing the carrier 20 and the retainer ring 30 are, usually, nearly the same per a unit area or are slightly different. In the wafer-polishing apparatus 1 of the present invention, however, the first pushing means 50 for generating the force for pushing the carrier 20 is provided along the outer periphery on the lower surface of the head body 40, and the second pushing means 60 for generating the force for pushing the retainer ring 30 is provided at a central portion under the lower surface of the head body 40. Therefore, the width A of space does not become as narrow as that of the conventional retainer ring-pushing means shown in FIG. 2, the pressure-receiving areas required by the two pushing means can be rationally determined maintaining margin, and the pushing means can be arranged with ease.

In employing the air bag made of a rubber sheet as a pushing means, when the air bag has a narrow width A as in the prior at, the rubber does not expand to a sufficient degree, and the pushing force is controlled with difficulty. In the wafer-polishing apparatus of the present invention, however, the air bag has a sufficiently large width A. Therefore, the rubber expands well, and the pushing force can be controlled maintaining good sensitivity.

According to the prior art, further, the air bag for the retainer ring is provided along the outer periphery under the lower surface of the head body. Therefore, the pressure-receiving area steeply increases with an increase in the width A of the air bag. To correctly control the pushing force, therefore, the air pressure must be finely controlled making it difficult to correctly control the force for pushing the retainer ring. According to the present invention, however, the pressure-receiving area that meets the force for pushing the retainer ring can be easily maintained, making it easy to correctly control the force for pushing the retainer ring.

While the invention has been described by reference to specific embodiments chosen for purposes of illustration, it should be apparent that numerous modifications could be made thereto by those skilled in the art without departing from the basic concept and scope of the invention.

What is claimed is:

1. An apparatus for polishing the surface of a wafer by holding the wafer by a holder head and pushing the wafer onto a polishing pad on a rotary polishing table, wherein:

said holder head includes a head body that rotates and is arranged being opposed to said polishing table, a carrier loosely supported by said head body so as to move up and down, and a retainer ring supported by said head body so as to move up and down and is arranged along the outer periphery of said carrier in concentric therewith so as to surround the periphery of the wafer at the time of polishing;

a first pushing means is arranged along the outer periphery under the lower surface of said head body to push said carrier holding the wafer onto said polishing pad; and a second pushing means is arranged at a central portion under the lower surface of said head body to push said retainer ring onto said polishing pad.

2. An apparatus for polishing wafers according to claim 1, wherein said first and second pushing means comprise air bags made of a rubber sheet.

3. An apparatus for polishing wafers according to claim 2, wherein said carrier is equipped with an air-blowing member that forms a pressurized air layer relative to the wafer, and transmits the pushing force of said first pushing means to the wafer through the pressurized air layer.

4. An apparatus for polishing wafers according to claim 1, wherein said carrier is equipped with an air-blowing member that forms a pressurized air layer relative to the wafer, and transmits the pushing force of said first pushing means to the wafer through the pressurized air layer.

* * * * *

UNITED STATES PATENT AND TRADEMARK OFFICE

CERTIFICATE OF CORRECTION

PATENT NO. : 6,409,583 B1
DATED : June 25, 2002
INVENTOR(S) : Numoto

It is certified that error appears in the above-identified patent and that said Letters Patent is hereby corrected as shown below:

Title page,
Item [73], Assignee, delete "Tokyo Seimtsu", insert -- Tokyo Seimitsu --.

Signed and Sealed this

Eighteenth Day of April, 2006

JON W. DUDAS
*Director of the United States Patent and Trademark Office*